United States Patent [19]

Brown

[11] 4,429,269

[45] Jan. 31, 1984

[54] FEED FORWARD AC VOLTAGE REGULATOR EMPLOYING STEP-UP, STEP-DOWN TRANSFORMER AND ANALOG AND DIGITAL CONTROL CIRCUITRY

[75] Inventor: Johnny F. Brown, Santa Clara, Calif.

[73] Assignee: Varian Associates, Inc., Palo Alto, Calif.

[21] Appl. No.: 367,646

[22] Filed: Apr. 12, 1982

[51] Int. Cl.[3] ..... G05F 5/00

[52] U.S. Cl. ..... 323/301; 323/259; 323/342; 323/344

[58] Field of Search ..... 323/258, 259, 301, 342, 323/343, 344; 363/101

[56] References Cited

U.S. PATENT DOCUMENTS

| | | | |
|---|---|---|---|
| 3,600,668 | 8/1971 | Goldberg | 323/258 X |
| 3,621,374 | 11/1971 | Kettler | 323/343 |
| 3,690,739 | 9/1972 | Prescott | 323/342 |
| 3,732,486 | 5/1973 | Schoendube | 323/258 X |
| 4,156,174 | 5/1979 | Specht | 323/342 |

*Primary Examiner*—William M. Shoop

*Attorney, Agent, or Firm*—Stanley Z. Cole; Norman E. Reitz

[57] ABSTRACT

A feed forward AC voltage regulator utilizes a step-up, step-down transformer to apply adjustment voltages to an unregulated AC line. Analog circuitry periodically samples the unregulated AC line input and compares it with a scaled representation of the desired line voltage. Digital circuitry converts the information from the analog sampling and comparison to an instruction command which activates an appropriate solid state switch associated with a tap on a multitap transformer connected to the regulated AC output line. The taps are successively located on the multitap transformer to provide selectable adjustment voltages of various values. The switched-in adjustment voltage is provided the proper polarity and applied to the primary of the step-up, step-down transformer, thereby applying to the secondary the adjustment voltage needed to move the regulated AC output line to the desired level.

12 Claims, 8 Drawing Figures

FIG.5
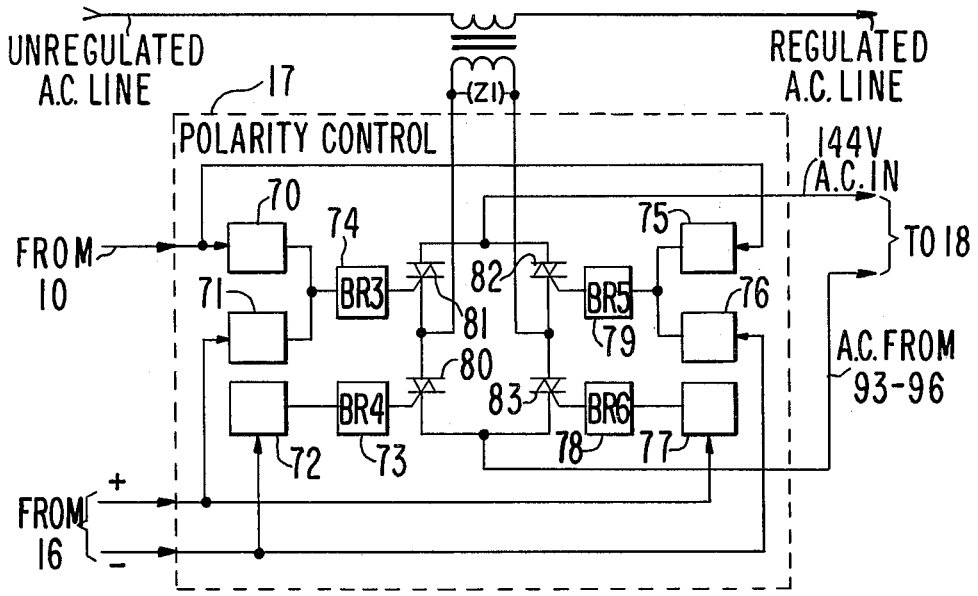
FIG.6
| | CONTROL | | | | | | TRIAC | | | |
|---|---|---|---|---|---|---|---|---|---|---|
| FUNCTION | 70 | 71 | 72 | 75 | 76 | 77 | 81 | 82 | 80 | 83 |
| START-UP | ● | | | ● | | | ● | ● | | |
| ADD | | ● | | | | ● | ● | | | ● |
| SUBTRACT | | | ● | | ● | | | ● | ● | |
| "Ø" (NULL) | | ● | ● | | ● | ● | ● | ● | ● | ● |
FIG.7
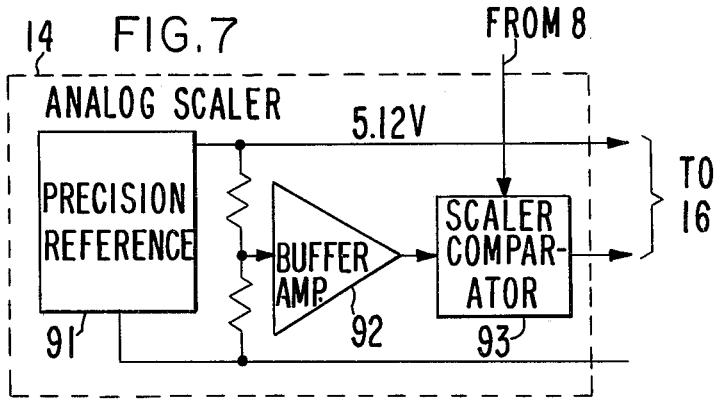

18
(+5V) ENABLE
ADJUSTMENT VOLTAGE SOURCE
TO 17
FROM REGULATED A.C. INPUT LINE
AUTO TRANSFORMER 111
AC
AC
81
85
89
101
105
93
97
82
86
90
102
94
98
FROM 58
83
87
91
103
95
99
FROM 59
nTH RESISTOR
nTH OPTO-ISOLATOR
nTH BRIDGE RECTIFIER
nTH TRANSFORMER SEGMENT
nTH TAP
nTH SWITCH

FEED FORWARD AC VOLTAGE REGULATOR EMPLOYING STEP-UP, STEP-DOWN TRANSFORMER AND ANALOG AND DIGITAL CONTROL CIRCUITRY

DESCRIPTION

This invention relates to a means for regulating AC line voltage and, more particularly, relates to a feed forward electronic regulator for regulating AC line voltage.

The regulation of AC line voltage has previously been accomplished in various ways. One conventional approach is to employ a motor to drive a variable transformer (also designated Variac®). The magnitude of the current which drives the motor is determined by the level of the incoming voltage and drives the shaft of the variable transformer to produce a higher voltage output if the incoming line voltage is low, and conversely, drives the variable transformer to produce a lower output voltage if the incoming voltage is high. Another approach is to utilize a motor driven Inductrol® in which a variable inductance is placed in series with the incoming line voltage. The inductance is varied, as necessary, to raise or lower the line voltage. A third approach is to perform ferro-resonant regulation by inserting a transformer winding in series with the incoming line voltage. The voltage is stabilized due to the principle of magnetic saturation, i.e., as the voltage is increased, saturation of the transformer core occurs and the line voltage is pulled down; conversely, as voltage goes low, the loading of the transformer decreases and line voltage tends to increase. See, e.g., W. Hemena, "Ferro-Resonant Transformer with Power Supply Regulation", IBM Tech. Discl. Bull., v. 22, p. 2903 (1979); and K. Onerud, et. al., "Primary Switched Power Supplies with Ferro-resonant Stabilization", Proceedings, Third International Telecommunications Energy Conference, pp. 138–143 (1981).

The inherent disadvantages of prior art AC regulation techniques includes slow reponse, wear on mechanical parts and linkages (especially for variable transformers) and frequency dependence (especially for ferro-resonant regulation). These disadvantages set the stage for the development of purely electronic regulation of AC voltages. One approach embodying such pure electronic regulation is that of deploying a series of triacs as branches between one side of the AC line and various primary inputs of a multiprimary switching transformer placed in the other line of the alternating current. By switching a particular triac in at any time, a particular voltage can be achieved in the output. The more triacs deployed between the AC line and the various primary inputs of the multiprimary switching transformer, the finer the regulation. This approach, however, requires the full current being drawn by the load to pass through the particular triac which is switched in. Thus, for power amplifiers, a triac with a high current rating must be employed. These are necessarily expensive and power losses would be expected through them. See, for example, the AC line regulator described in AC Line Regulator Brochure, Power-Matic, Inc., 7667 Vickers Street, San Diego, Calif. 92111.

It is an object, therefore, of the present invention to achieve voltage regulation of an AC line by purely electronic means.

It is another object of the present invention to provide reliable electronic regulation of AC line voltage.

It is an additional object of the present invention to provide electronic regulation of AC line voltage by low power solid state components.

It is an additional object of the present invention to produce electronic regulation of an AC voltage which does not significantly affect the power factor.

It is a further object of the present invention to provide independent phase regulation of a multiple phase AC voltage.

BRIEF DESCRIPTION OF THE DRAWINGS

For a more complete understanding of the feed forward AC voltage regulator of the present invention, reference may be had to the accompanying drawings which are incorporated herein by reference and in which:

FIG. 5 is a block diagram of the step-up, step-down transformer and the polarity control circuit;

FIG. 6 is a truth table for the polarity control circuit;

FIG. 7 is a block diagram of the analog scaler; and

SUMMARY OF THE INVENTION

Figure 1:
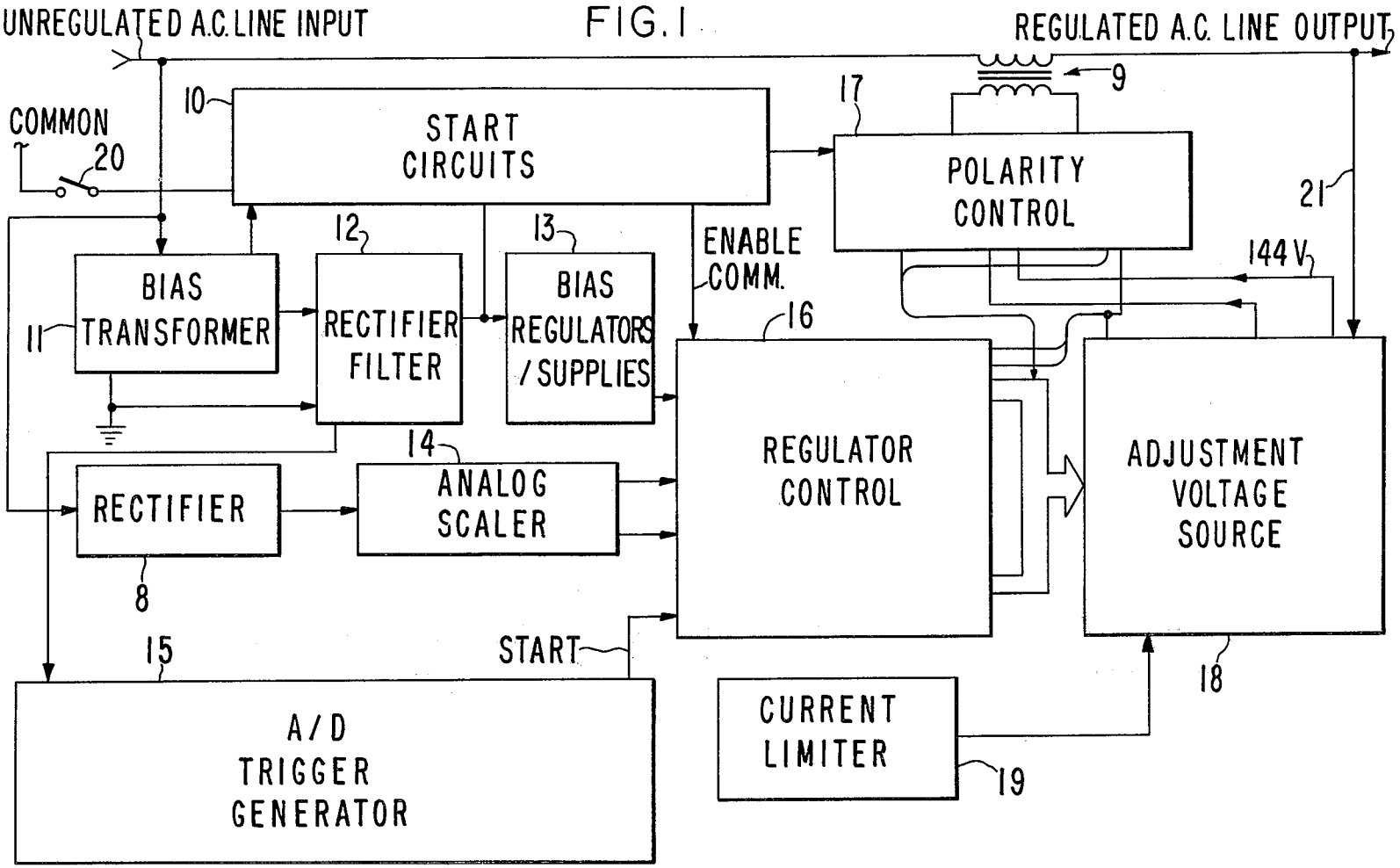
FIG. 1 is an overall block diagram of the AC voltage regulator of the present invention.

The feed forward AC voltage regulator employs a step-up, step-down transformer to apply adjustment voltages to an unregulated AC line. Analog circuitry periodically samples the unregulated AC line input and compares it with a scaled representation of the desired line voltage. Digital circuitry is utilized to convert the information from the analog sampling and comparison to an instruction command which activates an appropriate solid state switch associated with a tap on a multitap transformer connected to the regulated AC output line. The taps are successively located on the multitap transformer to provide selectable adjustment voltages of various values. The switched-in adjustment voltage is provided the proper polarity and applied to the primary of the step-up, step-down transformer, thereby applying to the secondary the adjustment voltage needed to move the regulated AC output line to the desired level.

DESCRIPTION OF THE PREFERRED EMBODIMENT

Electronic regulation of AC line voltage is accomplished through a step-up, step-down transformer (also called a buck boost transformer) in a feed forward manner, i.e., the incoming AC line voltage is sampled, compared with a reference and, if necessary, an adjustment is made to the line voltage to produce on the output line the desired voltage level. The incoming AC line is thus unregulated whereas the output AC line is regulated. The gain of the sampling, comparison and adjustment circuitry is necessarily unity because of the open loop regulation techniques used.

In the feed forward electronic regulator of the present invention the incoming line voltage is stepped up or down through what is conventionally called a buck boost transformer, the term "boost" connoting the increasing of line voltage, and the term "buck" connoting the reduction of line voltage. The regulated voltage is divided in an additional, segmented transformer, such as an auto transformer, to produce a series of incremental voltages which are available to be tapped and fed back, with appropriate polarity, to the step-up, step-down transformer to produce the desired regulation. These incremental correction voltages are added or subtracted to the line voltage as required by the level of the incoming line voltage, to adjust the output voltage to the desired line level. Digital logic circuitry is employed to translate any discrepancy between the incoming AC line and the desired line reference level into signals which actuate solid state switches to access the appropriate position on the windings (sometimes called taps) on the additional segmented transformer. The incremental correction voltage, if any, is applied through the polarity control circuit to the secondary of the buck boost transformer. The impact on the secondary of the step-up, step-down transformer is to adjust for any unwanted deviation in the voltage of the AC input line. The electronic regulation is preferably applied independently to each phase of the line voltage. Thus, appropriate corrections are made for each phase and there is no averaging of corrections between phases or no correction of one phase with only partial correction of the others. The subsequent discussion in this specification relates to regulation of a single phase. In practicable systems three or more regulators in accordance with this invention would be employed, each regulating a particular phase. In such a three-phase system, the electrically active line (hot) will necessarily be regulated in order to effect independent regulation, whereas with a single phase line, either the hot line or the neutral line may be regulated.

The feed forward AC voltage regulator of the present invention is shown in the block diagram of FIG. 1. One winding of step-up, step-down transformer 9 (the secondary winding) connects the unregulated incoming AC line with the regulated AC output line. The other winding (the primary winding) is connected to the polarity control circuitry shown in detail in FIG. 5. As described subsequently, a correction voltage from adjustment voltage source 18 is supplied, if needed, to step-up, step-down transformer 9 through polarity control circuit 17. The magnitude of the adjustment voltage is supplied by adjustment voltage source 18 and the sign of the adjustment voltage which determines whether it is additive or subtractive is supplied by polarity control circuitry 17. These voltages are switched in as appropriate by the digital control circuitry in regulator control 16 to provide an additive (boost) or subtracting (buck) voltage to the AC line. The series comprising bias transformer 11, rectifier filter 12 and bias regulators/supplier 13 receives the incoming unregulated AC line, transforms and rectifies it and supplies the power for all the elements.

The feed forward electronic regulator is turned on by closing switch 20. Through the functioning of Start Circuit 10 the various circuits are turned on and stabilized for a short period, on the order of 1 second, before regulation occurs. The incoming AC line voltage is rectified by rectifier 8 and supplied to analog scaler 14. Analog scaler 14 scales down the incoming AC line voltage and compares it with an internal reference which represents the desired AC line level. An analog error signal representing the difference between the actual incoming AC line level and the desired level is provided to Regulator Control circuit 16 which converts the analog error signal to a digital form. This digital representation serves as an instruction to adjustment voltage source 18 to switch in the appropriate incremental voltage adjustment to correct for the voltage difference. This instruction is provided periodically in one embodiment once each cycle of the AC voltage. The timing for providing this instruction is provided by A/D Trigger Generator 15. The current limiter 19 serves to protect the solid state switches in adjustment voltage source 18 from overcurrent conditions. Adjustment voltages are generated within the adjustment voltage source 18 by selective accessing of a segmented transformer connected to the regulated AC output line.

Figure 2:
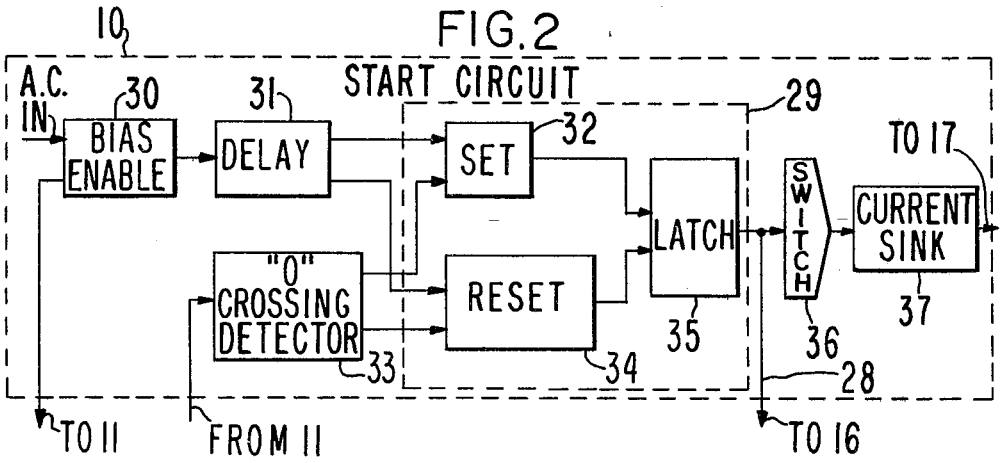
FIG. 2 is a block diagram of the start circuits.
Figure 3:
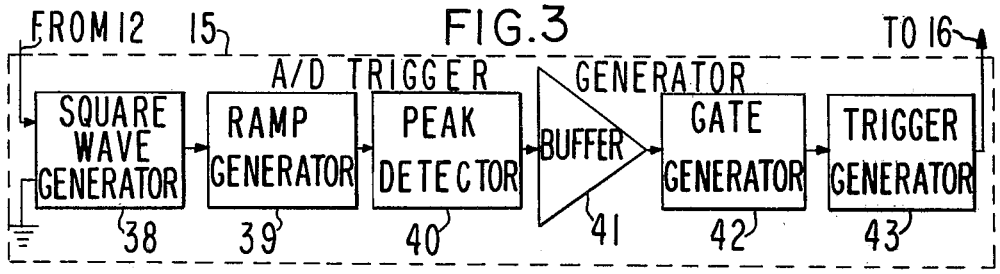
FIG. 3 is a block diagram of the analog-to-digital trigger generator.

The Start Circuit is shown in detail in FIG 2. It inhibits the regulation function of the regulator until certain preconditions are met. Thereafter, regulation is accomplished so long as AC line voltage is present and other limits such as overcurrent are not exceeded. When switch 20 of FIG. 1 is thrown, the Start Circuit 10 turns on the solid state switches in the polarity control circuit 17, virtually shorting the step-up, step-down transformer 9 for about one second to allow for stabilization of the bias supplies, and the analog scaler 14 and regulator control 16. For this preliminary period the AC input line voltage appears at the output. Within Start Circuit 10, as shown in FIG. 2, the AC input line is introduced to bias enable 30 which inhibits operation until the bias voltage reaches a predetermined acceptable operating level. The output of bias enable 30 is connected through delay 31 to set circuit 32. In combination with reset circuit 34 and latch 35, a set-reset latch function 29 is provided which can only be activated during a signal from "O" crossing detector 33. This prevents communication of the enable command 28 to regulator control 16 so that the solid state switches in adjustment voltage source 18 are not activated. Analog scaler 14, A/D trigger generator 15 and the circuitry within regulator control 16 are thus initially allowed to become stabilized. From the moment switch 20 is turned on, bias transformer 11 is connected to the AC input line so that the logic circuitry in Analog Scaler 14, A/D Trigger Generator 15 and Regulator Control 16 are turned on. At the end of this delay period the upper input to set circuit 32 is activated. Then, when the next zero crossing in the AC waveform is detected by zero crossing detector 33, the lower input to set circuit 32 is activated. At this point latch 35 is set and switch 36 deactivates the self-biasing current sink 37. Until then, the current had passed through current sink 37 and flowed to the solid state switch controls of the polarity control circuit 17, thus shorting out step-up, step-down transformer 9. This occurs only during the time delay period. Set-reset latch function 29 is only reset when the bias voltage goes below a safe operating level.

Analog Scaler 14 is shown in detail in FIG. 7. The rectified representation of the incoming AC line voltage is taken from rectifier 8. In one embodiment, precision reference 91 supplies a voltage of 5.12 volts to the regulator control 16 and a voltage divided 2.56 volts to buffer-amplifier 92 which supplies a 2.56 volt reference to analog scaler 93. When the incoming AC line voltage is 120 volts, the output of analog scaler 93 will be a zero error voltage of 2.56 volts. If the AC line input varies from 120 volts, the output of the analog scaler will vary accordingly. The output of scaler comparator 93 serves as an error signal to dictate the adjustment required to be selected from adjustment voltage source 18 by regulator control circuit 16. The output of analog scaler 93 and thus the signal from Analog Scaler circuit 14 to Regulator Control circuit 16 will move above or below 2.56 volts in accordance with whether the AC line input is above or below 120 volts. In one embodiment, the variation is 160 millivolts for every deviation in line voltage of one volt. The continuous output of Analog Scaler 14 is supplied to Regulator Control 16.

Figure 4:
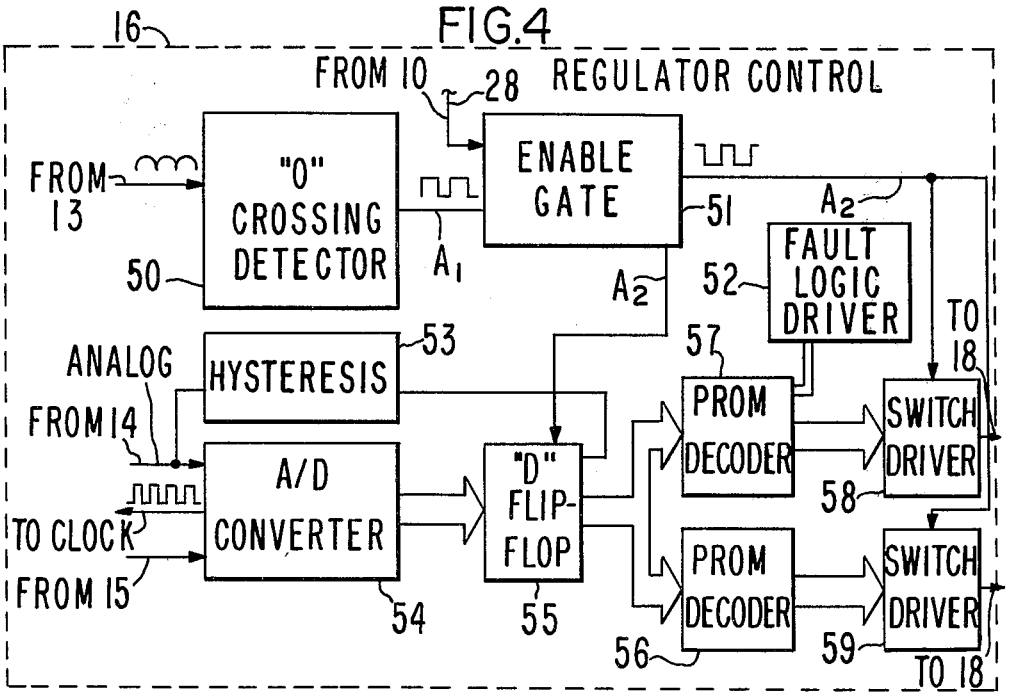
FIG. 4 is a block diagram of the regulator control.

Regulator Control circuit 16 is shown in detail in FIG. 4. The analog error signal from Analog Scaler 14 is introduced to A/D Converter 54 which converts the error signal to a digital number. The error signal will be the voltage output of comparator 93 in Analog Scaler 14 and will have a varying magnitude which reflects the deviation above or below the desired line voltage. Since the adjustment voltages are selectable in single volt increments, for every 160 mv from this desired level a new digital address is accessed within A/D converter 54. Hysteresis circuit 53 ensures a positive selection of a new address once the error signal enters the hysteresis band about the precise error signals corresponding with single volt increments. Thus, even if the error signal varies slightly above or below a precise deviation of 160 mv, the digital address associated with the required adjustment will be selected. This circuit operates in the standard manner of Schmitt Trigger circuits. Thus, as seen in Table 1, there is a required correction associated with each error signal. For example, between 2.40 volts and 2.72 volts no correction is required, between 3.84 and 4.00 volts an subtractive correction of 8 volts is required and between 1.76 and 1.60 volts, a additive correction of 5 volts is required. These corrections are applied once the error signal reaches the voltage band about each error signal; this band typically has a width of 20 mv, with 10 mv being on either side of the precise error signal which corresponds to an even correction voltage. A given adjustment continues to be applied until and unless the error signal falls outside the hysteresis band.

Within regulator control 16 shown in detail in FIG. 4 the "O" crossing detector 50 receives a rectified, scaled down representation of the line voltage from bias supplies 13. A pulse train $A_1$ contains a single pulse for zero crossover, i.e., for both positive going and negative going crossovers. Pulse train $A_1$ passes through enable gate 51 which opens upon receipt of an enable command on line 28 from start circuit 10; this occurs after the start up delay and only upon a "O" crossing. Pulse train $A_2$ is fed to "D" flip-flop 55 so that the digital output of A/D converter 54 is introduced to PROM decoders 56 and 57 only upon zero crossovers. Independently, pulse train $A_2$ is introduced to switch drivers 58 and 59 so that the switching signals from PROM decoders 56 and 57, in any event, will only be communicated to the solid state switches in adjustment voltage source 18 when zero crossovers occur. Thus, once each zero crossover of the AC line voltage a digital address for a specific PROM is supplied through switch drivers 58 and 59 to adjustment voltage circuit 18.

Figure 8:
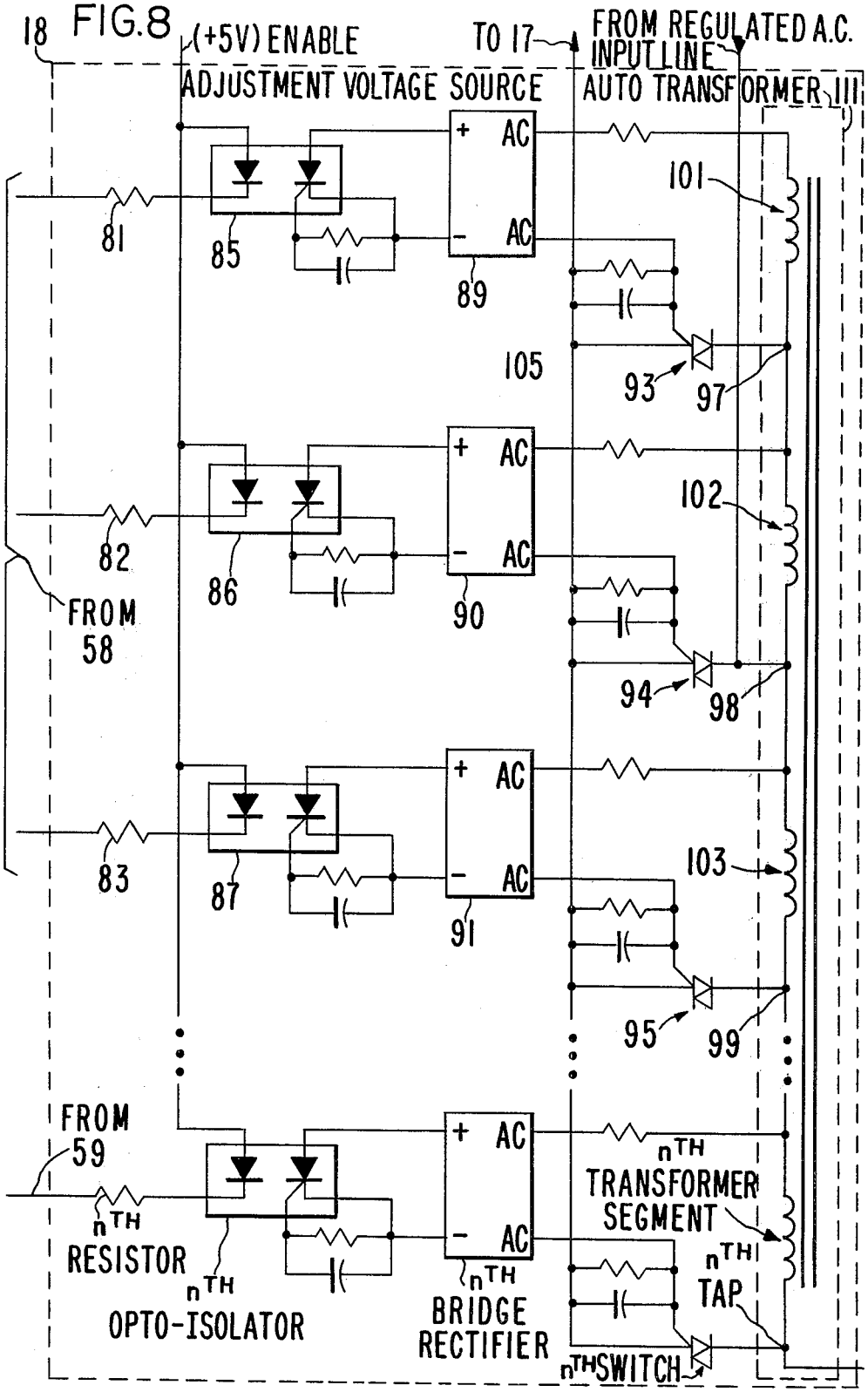
FIG. 8 is a block diagram of the adjustment voltage source.

Adjustment voltage source 18 is shown in detail in FIG. 8. An autotransformer 111 has segments 101, 102, 103 . . . with associated taps 96, 97, 98, 99 . . . The number of segments and their relative voltages will determine the fineness of the regulation. Each segment is accessed through its associated tap by a solid state switch, e.g., triac 93 which is switched by an associated RC network, bridge rectifier 89 and optoisolator 85 which receives its instruction from PROM decoders 58 or 59. In this way, a particular tap associated with a particular segment of the autotransformer is accessed pursuant to an instruction from the digital control circuitry in regulator control 16; when the tap is accessed the associated adjustment voltage is communicated to polarity control circuit 17 and thence to the primary of step-up, step-down transformer 9. Step-up, step-down transformer 9 in one embodiment has a 10:1 ration between this primary winding and the secondary winding corrected between the unregulated and regulated portions of the AC line. Thus, for a correction of two volts the adjustment voltage from adjustment voltage source will be 20 volts. The rating of the step-up, step-down transformer as well as the segmentation on the autotransformer of the adjustment voltage source may be chosen to produce optimum regulation.

Polarity control circuit 17, shown in detail in FIG. 5, serves to assign the appropriate polarity to adjustment voltages provided by adjustment voltage source 18. Polarity information is included in the digital correction instruction produced by PROM decoder 56 in regulator control 16, as shown in columns 3 and 4 of PROM decoder truth table in Table I. The adjustment voltage produced by adjustment voltage source 18 to opposing sides of a bridge configuration of solid state switches 80, 81, 83, 82. The secondary winding of step-up, step-down transformer 9 is connected to each of the other two sides of the bridge. This bridge serves to impress the adjustment voltage directly upon the primary winding or in reverse polarity upon the winding, thereby assuring the polarity of the adjustment. The switching of solid state switches 80, 81, 83, 82 is accomplished by opto-isolator/bridge rectifier pairs 72, 73, 71, 74; 77, 78; and 75, 79 in accordance with the polarity signals from regulator control 16. The switching scheme may be seen by reference to the truth table of FIG. 6.

Operation

The method of operation of the feed forward electronic regulator of the present invention may be seen by examining regulation accomplished for various voltage levels for the incoming AC line voltage. The reference to which the line voltage is regulated is the nominal line level of 120 volts.

Example 1: 2 Volts Overvoltage

The first example described is of the first voltage condition sensed on the unregulated portion of the AC line after startup of the voltage regulator. As switch 20 is closed, the instantaneous line voltage on the unregulated portion of the AC line is 122 volts. This is sensed in start circuit 10 and in bias transformer 11. Immediately, as described previously, the current sink in start circuit 10 is activated to fire the solid state switches in the polarity control circuit thus shorting the step-up, step-down transformer 9 until the control circuits stabilize.

Analog Scaler 14 receives a scaled-down, rectified representation of the unregulated line voltage of 122 volts. The scaled-down representation of the 122 volt line voltage is compared in scaler comparator 93 with the internal reference of precision reference 91. As described above, in one embodiment, the output of scaler comparator 93 and thus, the output of analog scaler 14, is set to be 2.56 volts if the input represents 120 volts on the unregulated AC line input. Every deviation of one volt from the desideratum of 120 volts will produce a variation of 160 millivolts. Thus, in this case, the output is 2.88 volts or 2.56 volts plus $2\times0.160$ volts.

See Table I. This output is presented by Analog Scaler 14 to regulator control 16.

Within regulator control 16, as shown in FIG. 4, A/D converter 54 receives the analog error signal. Subject to hysteresis analysis from circuit 53, a digital correction instruction is generated. As indicated in Table I, the voltage of 2.88 volts corresponds to a digital correction instruction of 01110 in A/D converter 54. This correction instruction is transmitted to the "D" flip-flop 55. This flip-flop serves as a memory to retain previous information until a clock signal $A_2$ is provided via enable gate 51 from "O" crossing detector 50. At the next succeeding "O" crossing, the binary correction instruction 01110 is applied to PROM decoders 56 and 57. Again, by referring to Table I, it can be seen that the binary correction instruction 01110 produces in the eight line output of PROM decoder 56, a condition of 00100100. The meaning of this condition is that a subtractive correction of two volts is required on the secondary of transformer 19. This is translated to an instruction to switch driver 59 and thence to the appropriate segment of the autotransformer 111 in adjustment voltage source 18. The output of PROM decoder 56 is also provided to polarity control circuit 17 to produce a subtractive correction. In this case, triac 94 is turned on thereby applying a twenty-volt correction signal to line 105 and thence to polarity control circuit 17. The twenty-volt correction signal is made negative in polarity control circuit 17 and applied to the primary of transformer 9 as a two-volt correction since transformer 9 is a 10:1 transformer. This reduces the unregulated incoming AC line voltage of 122 volts to a regulated output AC line voltage of 120 volts. This adjustment to the regulated AC output line is held until the next zero crossover of the unregulated AC input line, or until a different correction is required by the regulator control circuit.

Example 2: 3 Volts Undervoltage

This second example is described as occurring after startup and as a single step of regulation in a continuum of regulation steps. Analog scaler 14 receives the scaled-down, rectified 117 volt unregulated line voltage. This scaled-down representation of the 117 volt line voltage is compared in scaler comparator 93 with the internal reference of precision reference 91. Since the scaler comparator 93 will show 2.56 volts if the desired line voltage is received and a 160 millivolt deviation for any undervoltage or overvoltage, there is a decrement of $3\times0.160$ mv for the 3 volt undervoltage. A voltage of 2.08 volts is thus presented to regulator control 16.

The 2.08 voltage provided by analog scaler 14 is sensed by A/D converter 54 in regulator control 16 and the digital correction instruction 10011 is produced. This instruction is communicated through D flip flop 55 to PROM Decoders 56 and 57. Line 13 of PROM decoder 56 is addressed to produce on the eight-line output the condition 00100010. This correction instruction drives switch driver 59 which switches in the appropriate solid state switches in adjustment voltage source 18. To polarity control circuit 17 this signifies that an additive correction must be made. As shown in FIG. 8, triac 95 is switched on so that a thirty-volt signal is transmitted on line 105 and thence to polarity control circuit 17. Then finally a correction voltage of plus three volts is applied to the primary of step-up, step-down transformer 9. The polarity control circuit 17 applies the positive sign to the voltage so that an additive adjustment occurs.

TABLE I

| Error Signal (mv) | Adj. Req. (v) | A/D Converter 54 Address $A_4$ | $A_3$ | $A_2$ | $A_1$ | $A_0$ | | PROM Decoder 56 (32 × 8) Uv $B_7$ | OV $B_6$ | − $B_5$ | + $B_4$ | 1 $B_3$ | 2 $B_2$ | 3 $B_1$ | 4 $B_0$ | PROM Decoder 57 (32 × 8) 5 $B_7$ | 6 $B_6$ | 7 $B_5$ | 8 $B_4$ | 9 $B_3$ | 10 $B_w$ | 11 $B_1$ | 12 $B_0$ |
|---|---|---|---|---|---|---|---|---|---|---|---|---|---|---|---|---|---|---|---|---|---|---|---|
| | | 0 | 0 | 0 | 0 | 0 | 0 | 0 | 1 | 1 | 0 | 0 | 0 | 0 | 0 | 0 | 0 | 0 | 0 | 0 | 0 | 0 | 1 |
| | | 0 | 0 | 0 | 0 | 1 | 1 | 0 | 1 | 1 | 0 | 0 | 0 | 0 | 0 | 0 | 0 | 0 | 0 | 0 | 0 | 0 | 1 |
| | | 0 | 0 | 0 | 1 | 0 | 2 | 0 | 1 | 1 | 0 | 0 | 0 | 0 | 0 | 0 | 0 | 0 | 0 | 0 | 0 | 0 | 1 |
| | | 0 | 0 | 0 | 1 | 1 | 3 | 0 | 1 | 1 | 0 | 0 | 0 | 0 | 0 | 0 | 0 | 0 | 0 | 0 | 0 | 0 | 1 |
| 4.48 | −12 | 0 | 0 | 1 | 0 | 0 | 4 | 0 | 0 | 1 | 0 | 0 | 0 | 0 | 0 | 0 | 0 | 0 | 0 | 0 | 0 | 0 | 1 |
| 4.32 | −11 | 0 | 0 | 1 | 0 | 1 | 5 | 0 | 0 | 1 | 0 | 0 | 0 | 0 | 0 | 0 | 0 | 0 | 0 | 0 | 0 | 1 | 0 |
| 4.16 | −10 | 0 | 0 | 1 | 1 | 0 | 6 | 0 | 0 | 1 | 0 | 0 | 0 | 0 | 0 | 0 | 0 | 0 | 0 | 0 | 1 | 0 | 0 |
| 4.00 | −9 | 0 | 0 | 1 | 1 | 1 | 7 | 0 | 0 | 1 | 0 | 0 | 0 | 0 | 0 | 0 | 0 | 0 | 0 | 1 | 0 | 0 | 0 |
| 3.84 | −8 | 0 | 1 | 0 | 0 | 0 | 8 | 0 | 0 | 1 | 0 | 0 | 0 | 0 | 0 | 0 | 0 | 0 | 1 | 0 | 0 | 0 | 0 |
| 3.68 | −7 | 0 | 1 | 0 | 0 | 1 | 9 | 0 | 0 | 1 | 0 | 0 | 0 | 0 | 0 | 0 | 0 | 1 | 0 | 0 | 0 | 0 | 0 |
| 3.52 | −6 | 0 | 1 | 0 | 1 | 0 | 10 | 0 | 0 | 1 | 0 | 0 | 0 | 0 | 0 | 0 | 1 | 0 | 0 | 0 | 0 | 0 | 0 |
| 3.36 | −5 | 0 | 1 | 0 | 1 | 1 | 11 | 0 | 0 | 1 | 0 | 0 | 0 | 0 | 0 | 1 | 0 | 0 | 0 | 0 | 0 | 0 | 0 |
| 3.20 | −4 | 0 | 1 | 1 | 0 | 0 | 12 | 0 | 0 | 1 | 0 | 0 | 0 | 0 | 1 | 0 | 0 | 0 | 0 | 0 | 0 | 0 | 0 |
| 3.04 | −3 | 0 | 1 | 1 | 0 | 1 | 13 | 0 | 0 | 1 | 0 | 0 | 0 | 1 | 0 | 0 | 0 | 0 | 0 | 0 | 0 | 0 | 0 |
| 2.88 | −2 | 0 | 1 | 1 | 1 | 0 | 14 | 0 | 0 | 1 | 0 | 0 | 1 | 0 | 0 | 0 | 0 | 0 | 0 | 0 | 0 | 0 | 0 |
| 2.72 | −1 | 0 | 1 | 1 | 1 | 1 | 15 | 0 | 0 | 1 | 0 | 1 | 0 | 0 | 0 | 0 | 0 | 0 | 0 | 0 | 0 | 0 | 0 |
| 2.56 | 0 | 1 | 0 | 0 | 0 | 0 | 16 | 0 | 0 | 1 | 1 | 0 | 0 | 0 | 0 | 0 | 0 | 0 | 0 | 0 | 0 | 0 | 0 |
| 2.40 | +1 | 1 | 0 | 0 | 0 | 1 | 17 | 0 | 0 | 0 | 1 | 1 | 0 | 0 | 0 | 0 | 0 | 0 | 0 | 0 | 0 | 0 | 0 |
| 2.24 | +2 | 1 | 0 | 0 | 1 | 0 | 18 | 0 | 0 | 0 | 1 | 0 | 1 | 0 | 0 | 0 | 0 | 0 | 0 | 0 | 0 | 0 | 0 |
| 2.08 | +3 | 1 | 0 | 0 | 1 | 1 | 19 | 0 | 0 | 0 | 1 | 0 | 0 | 1 | 0 | 0 | 0 | 0 | 0 | 0 | 0 | 0 | 0 |
| 1.92 | +4 | 1 | 0 | 1 | 0 | 0 | 20 | 0 | 0 | 0 | 1 | 0 | 0 | 0 | 1 | 0 | 0 | 0 | 0 | 0 | 0 | 0 | 0 |
| 1.76 | +5 | 1 | 0 | 1 | 0 | 1 | 21 | 0 | 0 | 0 | 1 | 0 | 0 | 0 | 0 | 1 | 0 | 0 | 0 | 0 | 0 | 0 | 0 |
| 1.60 | +6 | 1 | 0 | 1 | 1 | 0 | 22 | 0 | 0 | 0 | 1 | 0 | 0 | 0 | 0 | 0 | 1 | 0 | 0 | 0 | 0 | 0 | 0 |
| 1.44 | +7 | 1 | 0 | 1 | 1 | 1 | 23 | 0 | 0 | 0 | 1 | 0 | 0 | 0 | 0 | 0 | 0 | 1 | 0 | 0 | 0 | 0 | 0 |
| 1.28 | +8 | 1 | 1 | 0 | 0 | 0 | 24 | 0 | 0 | 0 | 1 | 0 | 0 | 0 | 0 | 0 | 0 | 0 | 1 | 0 | 0 | 0 | 0 |
| 1.12 | +9 | 1 | 1 | 0 | 0 | 1 | 25 | 0 | 0 | 0 | 1 | 0 | 0 | 0 | 0 | 0 | 0 | 0 | 0 | 1 | 0 | 0 | 0 |
| .96 | +10 | 1 | 1 | 0 | 1 | 0 | 26 | 0 | 0 | 0 | 1 | 0 | 0 | 0 | 0 | 0 | 0 | 0 | 0 | 0 | 1 | 0 | 0 |
| .80 | +11 | 1 | 1 | 0 | 1 | 1 | 27 | 0 | 0 | 0 | 1 | 0 | 0 | 0 | 0 | 0 | 0 | 0 | 0 | 0 | 0 | 1 | 0 |
| .64 | +12 | 1 | 1 | 1 | 0 | 0 | 28 | 0 | 0 | 0 | 1 | 0 | 0 | 0 | 0 | 0 | 0 | 0 | 0 | 0 | 0 | 0 | 1 |
| | | 1 | 1 | 1 | 0 | 1 | 29 | 1 | 0 | 0 | 1 | 0 | 0 | 0 | 0 | 0 | 0 | 0 | 0 | 0 | 0 | 0 | 1 |
| | | 1 | 1 | 1 | 1 | 0 | 30 | 1 | 0 | 0 | 1 | 0 | 0 | 0 | 0 | 0 | 0 | 0 | 0 | 0 | 0 | 0 | 1 |
| | | 1 | 1 | 1 | 1 | 1 | 31 | 1 | 0 | 0 | 1 | 0 | 0 | 0 | 0 | 0 | 0 | 0 | 0 | 0 | 0 | 0 | 1 |

What is claimed is:

1. A feed forward electronic regulator for regulating voltage on an AC line, comprising:

a step-up, step-down transformer having one winding placed in said AC line inbetween the unregulated and regulated portions of said line;

analog circuitry electrically connected to said unregulated portion of said AC line, said analog circuitry including circuit means for generating an internal reference voltage representing the desired voltage level for said AC line, said analog circuitry further including circuit means for comparing the voltage level sensed in said unregulated portion of said AC line with said internal reference voltage and for generating an error signal which represents the discrepancy between said internal reference voltage and said voltage sensed in said unregulated portion of said AC line;

digital control circuitry electrically connected to said analog circuitry for receiving said analog error signal and in response thereto generating a digital instruction which corresponds to a particular incremental correction voltage required to adjust said voltage of said AC line to said desired voltage level;

a segmented transformer having multiple taps configured thereon, one winding of said segmented transformer being electrically connected to said regulated portion of said AC line;

an array of solid state switches, each of said switches being connected between a particular one of said taps on said segmented transformer and said digital control circuitry, said switches being selectively actuated by said digital instruction to make available a particular incremental correction voltage from said segmented transformer; and polarity control circuitry electrically connected between said array of solid state switches and the other winding of said step-up, step-down transformer to receive said particular incremental correction voltage from said array and apply it to said other winding with the requisite polarity to obtain regulation.

2. A feed forward electronic regulator in accordance with claim 1 wherein said segmented transformer comprises a segmented autotransformer.

3. A feed forward electronic regulator in accordance with claim 2 in combination with a trigger generator electrically connected between said unregulated AC line and said digital control circuitry whereby said digital control circuitry is periodically actuated.

4. A feed forward electronic regulator in accordance with claim 3 wherein the periodicity of actuation of said digital control circuitry is a function of the periodicity of said unregulated portion of said AC line voltage.

5. A feed forward electronic regulator in accordance with claim 4 wherein said periodicity of actuation is once every cycle of said AC line.

6. A feed forward electronic regulator in accordance with claim 3 wherein said analog circuitry includes rectifying means electrically connected to said unregulated AC line and analog scaler means connected to said rectifying means for comparing a rectified representation of the voltage level of said unregulated AC line from said rectifying means with an internally generated reference voltage.

7. A feed forward electronic regulator in accordance with claim 2 wherein said step-up, step-down transformer contains a 10:1 transformer ratio between said other (primary) winding and said one (secondary) winding.

8. A feed forward electronic regulator in accordance with claim 7 wherein said segments of said autotransformer comprise equal portions of the winding of said autotransformer.

9. A feed forward electronic regulator in accordance with claim 3 in combination with current limiter means electrically connected to said AC line and to said array of solid state switches whereby said periodic actuation of said digital control circuitry and said actuation of said solid state switches is overridden if an overcurrent condition is sensed.

10. A feed forward electronic regulator in accordance with claim 3 in combination with a start circuit electrically connected to said unregulated portion of said alternating current line and to said digital control circuitry to prevent actuation of said array of solid state switches for a finite stabilization period prior to initiation of regulation.

11. A feed forward electronic regulator in accordance with claim 1 wherein said array of solid state switches comprises an array of triacs.

12. A feed forward electronic regulator in accordance with claim 11 wherein said triacs are connected individually to said digital control circuitry through a bridge rectifier and optoisolator.

* * * * *